US009872528B1

(12) United States Patent
Venturi

(10) Patent No.: US 9,872,528 B1
(45) Date of Patent: Jan. 23, 2018

(54) KNOT TYING DEVICE

(71) Applicant: Simone Venturi, Florence (IT)

(72) Inventor: Simone Venturi, Florence (IT)

( * ) Notice: Subject to any disclaimer, the term of this patent is extended or adjusted under 35 U.S.C. 154(b) by 0 days.

(21) Appl. No.: 15/541,734

(22) PCT Filed: Feb. 9, 2016

(86) PCT No.: PCT/IB2016/050662
§ 371 (c)(1),
(2) Date: Jul. 6, 2017

(87) PCT Pub. No.: WO2016/135575
PCT Pub. Date: Sep. 1, 2016

(30) Foreign Application Priority Data

Feb. 25, 2015 (IT) ..... UB15A0612

(51) Int. Cl.

| | |
|---|---|
| ***A41D 25/14*** | (2006.01) |
| ***A41D 25/08*** | (2006.01) |
| ***A41D 25/12*** | (2006.01) |
| ***A41D 25/02*** | (2006.01) |
| *A44B 6/00* | (2006.01) |

(52) U.S. Cl.
CPC ..... *A41D 25/14* (2013.01); *A41D 25/025* (2013.01); *A41D 25/08* (2013.01); *A41D 25/12* (2013.01); *A44B 6/00* (2013.01)

(58) Field of Classification Search
CPC ..... A41D 25/00; A41D 25/14; A41D 25/003; A41D 25/025; A41D 25/08; A41D 25/006; A41D 25/02; A41D 25/06; A41D 25/10; A41D 25/12; A41D 25/022; A44B 6/00
See application file for complete search history.

(56) References Cited

U.S. PATENT DOCUMENTS

| | | | | |
|---|---|---|---|---|
| 2,040,297 | A * | 5/1936 | Costantini | A41D 25/02 2/150 |
| 2,427,468 | A | 9/1947 | Clinton | |
| 2,642,572 | A * | 6/1953 | Tobias | A41D 25/02 2/150 |
| 3,235,880 | A * | 2/1966 | Hypps | A41D 25/08 24/66.3 |
| 3,825,955 | A * | 7/1974 | Penzel | A41D 25/022 2/150 |
| 5,390,370 | A * | 2/1995 | Koy | A41D 25/022 2/148 |
| 2002/0059675 | A1 | 5/2002 | Lee | |
| 2003/0213047 | A1* | 11/2003 | I | C07K 14/4753 2/144 |
| 2009/0256358 | A1 | 10/2009 | Fay | |
| 2014/0101819 | A1 | 4/2014 | Ike | |
| 2014/0317831 | A1* | 10/2014 | Woody | A41D 25/025 2/152.1 |

FOREIGN PATENT DOCUMENTS

| | | |
|---|---|---|
| GB | 2284975 | 6/1995 |

* cited by examiner

*Primary Examiner* — Ismael Izaguirre
(74) *Attorney, Agent, or Firm* — Themis Law

(57) ABSTRACT

A knot tying device for realizing a knot of a tie that has a narrower part and a wider part includes a ring defining an internal cavity for passage of the narrower part and an external surface of support for the wider part; a ferromagnetic body, integral to the ring; and a magnet suitable for resting on the wider part so as to overlap the ferromagnetic body, constraining itself to the ferromagnetic body and blocking the wider part to the ring.

9 Claims, 2 Drawing Sheets

KNOT TYING DEVICE

TECHNICAL FIELD

The present invention refers to a knot tying device of the type specified in the preamble of the first claim.

BACKGROUND ART

As it is known, in order to wear a tie it is necessary to arrange it around the neck and then to execute a knot.

The knot obtained varies according to shape/size on the basis of the operations executed.

Therefore, it is possible to obtain, for example, a double knot, a Windsor knot, a half Windsor knot, or a small knot.

Just as a way of example, we make here a brief description of one of the methods to knot a tie among the easiest ones, that is, the simple knot.

Such a method foresees: arranging the tie around the neck in such a way that the wider part and the narrower part are on opposite parts with respect to the neck; identifying a seam on the front part of the narrower part; crossing, under the neck, the wider part on the narrower part in correspondence of the seam; making the wider part slide under the narrower part; taking the wider part again on the narrower part so that it is placed on the opposite part with respect to the initial one forming, with the tie, a ring; making the wider part pass upwards, under the ring; making the wider part slide in the ring, keeping the narrower part still; pulling the wider part to close the ring; pulling the narrower part, bringing the knot to the neck; and adjusting the position of the knot.

As it is evident from the description above, the method, even if referred to the simple knot and, therefore, to the easiest one, results to be particularly complex, above all for those that are not experts in tying knots.

Another drawback is represented by the fact that, often, a knot is obtained with such defects as to impede that the knot and, therefore, the tie are in the correct position.

Often, in fact, the knot presents itself in a asymmetrical position and not centered and therefore it imposes an incorrect arrangement of the wider part and of the narrower part with respect to the clothing item.

A further drawback is in the fact that the wider part or the narrower part can be one much longer than the other one, determining a knot and, therefore, a tie of scarce aesthetic value.

In order to try to solve these drawbacks knot tying devices have been realized.

Such devices are usually constituted of a first button resting on the tie, a brooch integral to the first button and holing the tie and a second button presenting a lock catch to the brooch.

In this case, the method to knot the tie foresees that the operator grasps, with a hand, the wider and the narrower parts and closes them one to the other. At the same time, with the other hand, the operator makes the brooch pass through the wider part and the narrower part, bringing the first button against the wider part.

At this point, the operator detects the second button and constrains it to the brooch closing and, therefore, contracting the part of tie contained between the buttons.

Some examples are shown in U.S. Pat. No. 2,427,468A, U.S. Pat. No. 3,761,963A, U.S. Pat. No. 3,825,955A.

These devices, though having simplified the realization of the knot of a tie, present important drawbacks.

A first drawback is represented by the fact that the brooch, every time that the tie is knotted, realizes a new hole on the tie.

Therefore, the tie, also after being worn a few times, presents a plurality of holes that degrade the aesthetics and compromise the duration thereof.

Another drawback is in the fact that the operator can hurt himself with the brooch and, in some cases, stain the tie.

It is highlighted, last, how the knot executed with these devices does not present a good aesthetic aspect.

DISCLOSURE OF INVENTION

In this situation, the technical task on the basis of the present invention is that of ideating a knot tying device capable of substantially remedying the cited drawbacks.

In the field of said technical task it is an important aim of the invention to have a device that permits to realize, in a simple and quick manner, a tie knot having high aesthetic value.

Another important aim of the invention is a device that does not deteriorate the tie every time a knot is realized.

The technical task and the aims specified are reached with a knot tying device, suitable for realizing a knot (10*a*) of a tie (10) comprising a narrower part (12) and a wider part (11), as claimed in the annexed claim 1.

In particular, such a knot-tying device (1) comprises:

A ring (2) defining an internal cavity (2*a*) of passage for said narrower part (12) and an external surface (2*b*) of support for said wider part (11);

At least one ferromagnetic body (3), integral to said ring (2);

At least one magnet (4) suitable for resting on said wider part (11) so as to substantially overlap to said ferromagnetic body (3), constraining itself to said ferromagnetic body (3) and blocking said wider part (11) to said ring (2).

In such a manner, all said technical drawbacks are solved.

In particular, the device 1 allows now to realize, in a simple and quick manner, a knot 10*a* of a high aesthetic value.

In fact, it is now possible to adjust the position and the length of the wider part 11 and of the narrower part 12 before the completion of the knot 10*a* and this permits to avoid the inaestheticisms that often characterized the tie knots made so far.

Such an aspect is further guaranteed by the fact that it is now possible to rest the wider part 11 on the external surface 2*b*, guaranteeing the right shape of the knot 10*a*.

In fact, the wider part 11, resting on the external surface 2*b*, makes that the shape of the ring 2 defines the profile of the knot 10*a* that, therefore, does not result either inflated or flat.

Another advantage is in the fact that the device 1 permits to modify the knot 10*a* at any moment and in a simple and quick manner.

In fact, the operator, while first obliged to undo and subsequently re-do completely the knot 10*a*, has now to simply detach the magnets 4, move the wider part 11 and/or the narrower part 12 and, therefore, re-position the magnets 4.

Another advantage is given by the fact that the device 1 does not need brooches, needles or other similar elements that, holing the tie 10, degrade the tie itself 10.

Advantageously, said ring (2) is openable.

Advantageously, said ring (2) comprises two ends (22), mobile between them and constraining means (23) of said ends (22) defining an open configuration in which said ends (22) are movable between them, and a close configuration in which said ends (22) are constrained between them, closing said ring (2).

Advantageously, said device foresees also a hook (5), constraining said ring (2) and said tie (10).

Advantageously, such a hook (5) presents a substantially V-shaped profile.

Advantageously, said hook (5) comprises a first plate (51), integral to said ring (2), and a second plate (52), inclined with respect to said first plate (51) and constrained to said first plate (52), defining a junction edge (53).

Advantageously, said plates (51, 52) are rotatable between them along said junction edge (53), varying the reciprocal inclination between said plates (51, 52).

It is also described here a realization procedure (100) of a knot (10*a*) of a tie (10), using a knot-tying device (1) according to one or more of the preceding claims, said realization procedure (100) being characterized by the fact that it comprises:

A positioning phase (120) in which said narrower part (12) is placed in said internal cavity (2*a*);

A covering phase (130) in which said wider part (11) rests on said external surface (2*b*); and A blocking phase (140) in which said magnet (4) rests on said wider part (11) so as to substantially overlap to said ferromagnetic body (3), constraining itself to said ferromagnetic body (3) and blocking said wider part (12) to said ring (2).

Advantageously, a crossing phase (110) is comprised in which said wider part (11) executes a complete turn around said narrower part (12), forming an eyelet (14) of said wider part (11) around said narrower part (12), and in which in said positioning phase (120) said hook (5) is anchored to said eyelet (14).

BRIEF DESCRIPTION OF DRAWINGS

The features and advantages are below clarified in the detailed description of a preferred embodiment of the invention, with reference to the attached drawings, in which.

DESCRIPTION OF SOME PREFERRED EMBODIMENTS

Figure 1:
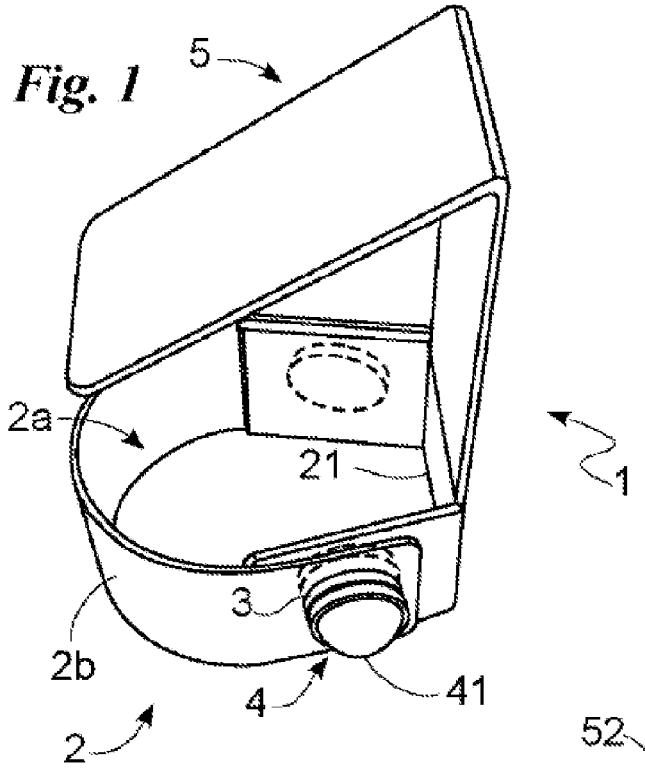
FIG. 1 shows a knot-tying device according to the invention.
Figure 2:
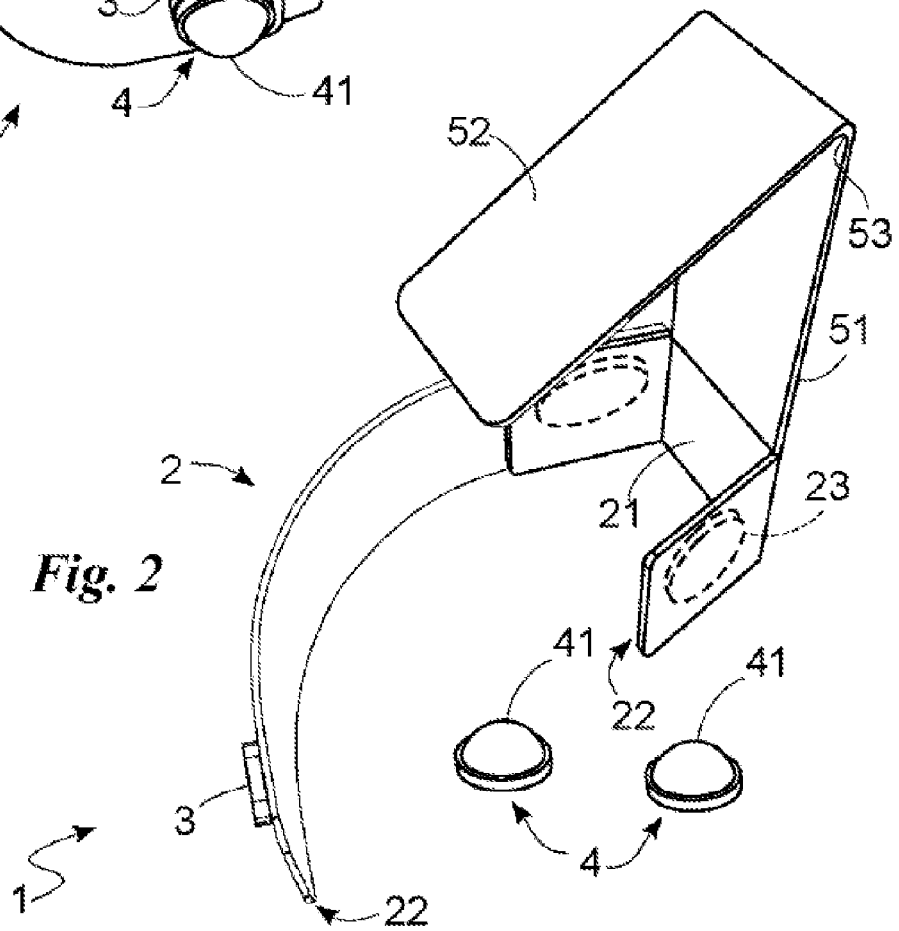
FIG. 2 illustrates a second view of the knot-tying device.

In the present document, the measures, the values, the shapes and the geometrical references (such as perpendicularity and parallelism), when associated to words such as "about" or other similar terms such as "almost" or "substantially", are to be intended as inaccuracy of measure or imprecisions due to errors of production and/or manufacturing and, above all, as a slight divergence from the value, from the measure, from the shape or geometric reference to which it is associated. For example, such terms, if associated to a value, preferably indicate a divergence not superior to the 10% of the value itself.

Further, when used, terms such as "first", "second", "superior", "inferior", "main" and "secondary" do not identify necessarily an order, a priority of relation or relative position, but can simply be used for distinguishing more clearly among them different components.

With reference to the cited figures, the knot-tying device according to the invention is globally indicated with number 1.

It is suitable to realize a knot 10*a* of a tie 10 including a wider part 11 identifying the wide portion of the tie 10 and a narrower part 12 identifying the narrow part of the tie 10.

The knot-tying device 1 comprises a ring 2 defining an internal surface delimiting an internal cavity 2*a* of passage for the narrower part 12 and an external surface 2*b* of support for the wider part 11 and opposed to the internal surface and, therefore, to the cavity 2*a*; at least one ferromagnetic body 3, integral to the ring 2; and at least one magnet 4 suitable for blocking the wider part 12 against the external surface of the ring 2, hiding almost entirely the device 1, except for the single magnets 4.

The ring 2 presents an almost rectangular profile or other profile defining a flat portion 21 of support for the wider part 10 when the device 1 is in use, that is worn and associated to a tie 10.

Preferably, the profile of the ring 2 is substantially D-shaped.

The ring 2 can be openable and, therefore, can comprise two ends 22, mobile between them, and constraint means 23 of the ends 22 defining an open configuration, in which the ends 22 are movable between them, and a close configuration in which the ends 22 are constrained between them, closing the ring 2.

The constraint means 23 can foresee an engagement, a clip-like or magnetic closure.

The ferromagnetic body 3 is suitable for being constrained integrally to the ring 2 in correspondence of the cavity 2*a* or, preferably, of the external surface 2*b*.

The magnet 4 is suitable for resting on the wider part 11 so as to substantially overlap to the body 3, constraining itself to it and, therefore, blocking the wider part 11 to the ring 2 against the external surface 2*b*.

It can present a coating 41 of the magnet 4 suitable for leaving in sight a single face of the magnet 4.

In detail, the device 1 has two ferromagnetic bodies and two magnets 4. The two bodies 3 are placed in correspondence of the external surface 2*b*. More precisely, they are placed laterally and next to the flat portion 21 so that, when the device 1 is in use, they can be covered by the wider part 11.

Additionally, the knot-tying device 1 can foresee a hook 5 of the ring 2 to the tie 10.

The hook 5 is constrained integrally to the ring 2 in correspondence of the flat portion 21. In particular, the hook 5 is in a single piece with the ring 2.

It presents a substantially V-shaped profile and comprises a first plate 51, integral and appropriately almost coplanar to the flat portion 21; and a second plate 52, inclined with respect to the first plate 51 and constrained to it on the opposite part to the portion 21, defining a junction edge 53.

Preferably, the plates 51 and 52 are rotatable between them along the junction edge 53, so as to vary the reciprocal inclination and, therefore, the angle width of the V-shaped profile of the hook 5.

The functioning of the knot-tying device, described above from the structural point of view, defines an innovative realization procedure 100 of a knot 10*a* suitable for being realized through the same device 1.

Figure 3:
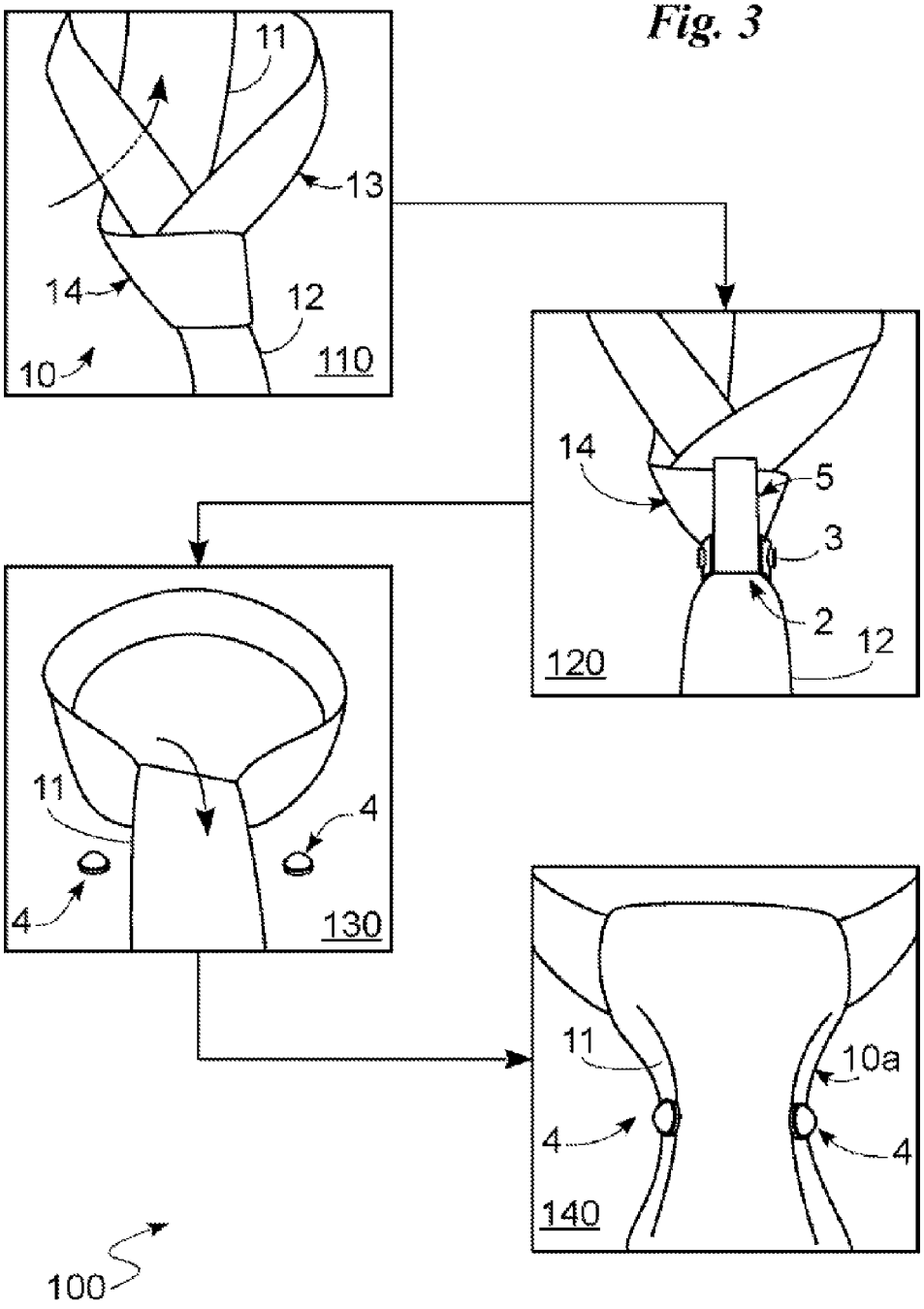
FIG. 3 schematizes the use of the knot-tying device.

The realization procedure 100, illustrated in FIG. 3, foresees, initially, a laying phase of the tie 10 around the neck of the user in such a way that the wider part 11 and the narrower part 12 are on opposed parts to the neck.

At this point, the procedure 100 includes a crossing phase 110 of the wider part 11 with respect to the narrower part 12; a positioning phase 120 in which the narrower part 12 is placed in the internal cavity 2*a*; a covering phase 130 of the ring 2 with the wider part 11; and a blocking phase 140 of the wider part 11 to the ring 2.

In the crossing phase 110 the operator makes the wider part 11 make a complete turn around the narrower part 12 so as to form a turn-over 13 of the tie 10 around the neck and an eyelet 14 of the wider part 11 around the narrower part 12.

The crossing phase 110 is concluded passing the wider part 12 inside of the turn-over 13. In the following positioning phase 120 the operator opens the ring 2 and arranges the flat portion 21 over the narrower part 12 so as to position itself between the wider part 11 and the narrower part 12, anchors the hook 5 to the eyelet 14 and closes the ring 2 around the narrower part 12 that, therefore, is placed in the internal cavity 2*a*.

It is highlighted how the wider part 11 is outside of the internal cavity 2*a*.

In the subsequent covering phase 130 the operator rests the wider part 11 on the external surface 2*b* and, by taking advantage of the absence of constraints on the wider part 11 and on the narrower part 12, adjusts the length of the wider part 11 and of the narrower part 12.

It is highlighted how the wider part 11 rests both on the flat surface 21 and on the first plate 51.

Alternatively, the adjustment phase of the length of the wider part 11 and of the narrower part 12 can be executed at the end of the crossing phase 110, that is before the constraint of the device 1 to the tie.

At this point, the procedure 100 is concluded with the blocking phase 140 in which one or more magnets 4 block the wider part 11 against the ring 2, completing the knot 10*a*.

In this blocking phase 140, the operator draws the magnets 4 near the wider part 11 and, in particular, the ferromagnetic bodies 3. Therefore, the magnets 4, attracted by the ferromagnetic bodies 3, clamping the wider part 11 against the ring 2, blocking it to the device 1 and, in particular, finishing the knot 10*a*.

The invention presents important advantages.

A first advantage, as shown from the description of the procedure 100, is in the fact that the device 1 realizes, in a simple and quick manner, a knot 10*a* of high aesthetic value.

In fact, to be able to adjust the position and the length of the wider part 11 and of the narrower part 12 before the completion of the knot 10*a* permits to avoid the inaestheticisms that usually characterized the tie knots made until now.

Such an aspect is further guaranteed by the fact that to rest the wider part 11 on the external surface 2*b* guarantees the right form of the knot 10*a*.

In fact, the wider part 11, resting on the external surface 2*b*, makes that the form of the ring 2 defines the profile of the knot 10*a* that, therefore, does not result either too inflated or too flat.

Such an aspect is, further, increased by the coating 41 that, being the only element in sight of the device 1 in use and being able to be realized in any shape and material, can constitute a precious clothing accessory.

Another advantage is in the fact that the device 1 permits to modify the knot 10*a* at any moment in a simple and quick manner.

In fact, the operator, while he was first obliged to undo and subsequently do again completely the knot 10*a*, has now to simply detach the magnets 4, move the wider part 11 and/or the narrower part 12 and, therefore, re-position the magnets 4.

Another advantage is given by the fact that the device 1 does not need brooches, needles or other similar elements that, holing the tie 10, degrade the tie itself 10.

The invention is susceptible of variants within the field of the inventive concept described in the independent claims and of the relative technical equivalents. In such a field, all the details can be substituted by equivalent elements and the materials, shapes and sizes can vary.

The invention claimed is:

1. A knot tying device (1), adapted to make a knot (10*a*) of a tie (10) comprising a narrower part (11) and a wider part (12), said knot tying device (1) comprising:

a ring (2) defining an internal cavity (2*a*) for passage for the narrower part (12) and having an external surface (2*b*) of support for said wider part (11);

at least one ferromagnetic body (3), integral to said ring (2); and at least one magnet (4) adapted for resting on said wider part (11) so as to substantially overlap the ferromagnetic body (3), said at least one magnet constraining itself to said at least one ferromagnetic body (3) and engaging said wider part (12) to said ring (2).

2. The knot tying device (1), as per claim 1, wherein said ring (2) is openable.

3. The knot tying device (1), as per claim 1, wherein said ring (2) comprises two ends (22) and a constraint element (23) of said ends (22), the two ends and the constraint element defining an open configuration, in which said ends (22) are movable one toward the other, and a close configuration, in which said ends (22) are constrained one to the other, closing said ring (2).

4. The A-knot tying device (1), as per claim 1, further comprising a hook (5) that constrains said ring (2) and said tie (10).

5. The knot tying device (1), as per claim 4, wherein said hook (5) presents a substantially V-shaped profile.

6. The knot tying device (1), as per claim 4, wherein said hook (5) comprises a first plate (51), integral to said ring (2), and a (52), inclined with respect to said first plate (51) and constrained to said first plate (51), defining a junction edge (53).

7. The knot tying device (1), as per claim 6, wherein said first and second plates (51, 52) are rotatable one in relation to the other along said junction edge (53), varying a reciprocal inclination between said plates (51, 52).

8. A method of making a knot (10*a*) of a tie (10) using a knot tying device (1), said tie having comprising a narrower part (11) and a wider part (12), the method comprising:

a providing step, in which knot tying device is provided that comprises, a ring (2) defining an internal cavity (2*a*) for passage for said narrower part (12) and having an external surface (2*b*) of support for said wider part (11);

at least one ferromagnetic body (3), integral to said ring (2); and at least one magnet (4) adapted for resting on said wider part (11) so as to substantially overlap the ferromagnetic body (3), said at least one magnet constraining itself to said at least one ferromagnetic body (3) and engages said wider part (12) to said ring (2);

positioning step (120), in which said narrower part (12) is placed in said internal cavity (2*a*);

a covering step (130), in which said wider part (11) rests on said external surface (2*b*); and a blocking step (140), in which said magnet (4) rests on said wider part (11) so as to substantially overlap said ferromagnetic body (3), becoming constrained to said ferromagnetic body (3) and engaging said wider part (11) to said ring (2).

9. The method, as per claim 8, wherein the step of providing comprises providing a hook (5) that constrains said ring (2) and said tie (10), further comprising a crossing step (110), in which said wider part (11) executes a complete turn around said narrower part (12), forming a eyelet (14) of said wider part (11) around said narrower part (12), wherein in said positioning step (120) said hook (5) is anchored to said eyelet (14).

* * * * *